US006086516A

United States Patent [19]

Santos

[11] Patent Number: 6,086,516

[45] Date of Patent: Jul. 11, 2000

[54] HAND AND ARM EXERCISE DEVICE

[76] Inventor: Peter J. Santos, 557 High Farms Rd., Stowe, Vt. 05672

[21] Appl. No.: 08/943,052

[22] Filed: Oct. 2, 1997

[51] Int. Cl.[7] ..... A61F 5/00

[52] U.S. Cl. ..... 482/5; 482/44; 482/49

[58] Field of Search ..... 482/1–9, 44–50; 602/13, 21, 22

[56] References Cited

U.S. PATENT DOCUMENTS

| | | | |
|---|---|---|---|
| 5,005,826 | 4/1991 | Merrick | 482/10 |
| 5,531,668 | 7/1996 | Mann et al. | 482/44 |
| 5,643,138 | 7/1997 | Huang | 482/4 |

*Primary Examiner*—Glenn E. Richmon

[57] ABSTRACT

The present invention is a hand and arm exercise device. The exercise device has a deformable elastic bulb having a central cavity. A first port is provided which communicates with the central cavity. A first check valve limits the flow through the first port such that a fluid can pass into but not out of the central cavity. A second port is provided which communicates with the central cavity, and with a chamber via a connecting passage therebetween. An adjustable bleed valve is provided in the passage. In one preferred embodiment the chamber is rigid, while in another preferred embodiment the chamber is elastic and a second check valve is provided in the second port to block flow into the central cavity of the deformable elastic bulb. It is further preferred that a pressure gauge be provided to the chamber so a user of the hand and arm exercise device can monitor his/her strength. The hand and arm exercise device is particularly well suited to exercises where it is beneficial to provide an isokinetic resistance against which the hand acts.

11 Claims, 2 Drawing Sheets

HAND AND ARM EXERCISE DEVICE

FIELD OF THE INVENTION

This invention relates to an exercise device for the hand and arm, specifically to such exercise devices which are used for rehabilitation.

BACKGROUND OF THE INVENTION

The hand and forearm constitute a complex arrangement of muscles and ligaments that enable a person to perform a multitude of complicated tasks requiring strength and dexterity.

A continuous muscular stress greater than approximately 15% of the maximum stress of a muscle group results in early fatigue of that muscle group with attendant compromise of task effectiveness, increased musculoskeletal disorders, and accident rates. (W. Rohmert, Applied Ergonomics, Vol. 4, pages 91–95, 1973; Butterworth Scientific Ltd.) It is therefore vitally important to develop means to exercise these various hand and forearm muscle groups which are activated in pursuit of everyday activities to improve work quality and recreational pleasures while reducing musculoskeletal injuries.

A number of hand exercisers have been invented that are generally single resistance level devices or whose resistance adjustments are comprised of springs or rubber bands. All of these devices offer a resistance that varies with the movement of the grip, getting progressively more difficult as the muscles are flexed. This progressive resistance can be limiting because the strength needed for squeezing is at a fixed level for any given point during muscle flexion.

Examples of progressive resistance exercisers include U.S. Pat. No. 4,222,560, No. 4,530,496, and No. 5,643,138. They all describe devices that are closed fluid systems, having chambers filled with fluid which have no interaction with atmospheric air. These progressive resistance exercisers employ resistance directly in proportion to the force applied to them and they have no means for adjustment of that resistance.

With these devices, weaker users reach their maximum strength level before they have exercised the full range of motion of their hand which is often so important for such users. Isokinetic resistance, however, or the exertion of muscle force at a constant velocity, allows for different strengths at any given point during muscle flexion because resistance depends on the speed at which the muscle is contracting. In other words, the difference is that when a user is at the extreme end of their muscle contraction, a progressive resistance exerciser is at its most difficult with resistance being the greatest. An isokinetic resistance exerciser, however, is at the same resistance level as throughout the exercise range providing that the speed of the muscle contraction remains constant. Therefore, weaker users can exercise their full range of motion at a rate comfortable to them with isokinetic resistance.

U.S. Pat. No. 4,949,729 and U.S. Pat. No. 5,005,826 are similar to the progressive exercisers but they include bladders that are pre-inflated. These pre-inflated bladders can be set to different levels of pressure before being compressed. Once the pressure level is set, however, the bladders become closed systems, thereby making the devices progressive exercisers with the limitations set forth above.

U.S. Pat. No. 5,338,276 describes a pressure pad in the form of a flexible bladder or bag which comprises a plurality of substantially separate compartments, a pumping means in the form of a pressure bulb or air bulb, and a feedback means in the form of an aneroid dial to permit monitoring or metering of pressure biofeedback transmitted to the pressure pad from the body part of the patient. Also provided is valve means in the form of a regulating screw which may regulate the air flow between the air bulb and aneroid dial. This is similar to a sphygmomanometer, a device used to measure blood pressure. For users to encounter significant resistance in the hand by squeezing the pressure bulb, the pressure pad must first be mostly inflated which, because is has a plurality of substantially separate compartments, may take a number of squeezes of the pressure bulb, or there must be significant pressure against the pressure pad by a body part other than the hand squeezing the pressure bulb. Immediate resistance and feedback is not possible. In addition, the biofeedback is a result of the pressure of that body part on the pressure pad, rather than by the hand squeezing the pressure bulb.

U.S. Pat. No. 3,542,363 departs from the previous patents by employing a deformable bulb for exercising the hand, having air flow control means that allows a rapid intake of air when the bulb expands and resistance to the expulsion of air when the bulb is collapsed. The primary limit of this invention is that it has no means for adjustment. The isokinetic resistance it offers is solely for a single resistance level. If a weaker user wants to exercise the hand over the full range of motion at a high frequency, they cannot do so because the single outlet of air from the bulb remains fixed, so the weaker user must reduce their rate of squeezing which lessens the resistance and therefore the frequency of the squeezing is reduced, contrary to the goal. An outlet that could be adjusted to be bigger would solve this problem. Conversely, stronger users who wish to squeeze at a low frequency with greater resistance cannot do so because their strength forces air out of the outlet too fast, increasing the frequency which is contrary to the goal. An outlet that could be adjusted to be smaller would solve this problem. In addition, because the single outlet of air cannot be closed off, it does not offer progressive resistance as an alternative level of exercise.

There is a need for the present invention because most hand and arm exercisers do not offer the range of strength levels and differing resistances that the present invention offers. Also, many require a closed system that may leak fluid over time. Even the device in the '363 patent is limited in this capacity by not having means for adjustment. In addition, measuring the level of strength being exerted in many of these devices requires a second body part, other than the hand, to accomplish the measurement. The present invention overcomes these limitations by offering both progressive resistance and adjustable isokinetic resistance, as well as means for measuring the strength being exerted solely by the hand and arm, in a single, comfortable device.

OBJECTS OF THE INVENTION

It is the object of the present invention to provide a device that offers adjustable, isokinetic resistance to the finger, hand and forearm muscles.

It is a further object of the present invention to provide a device that offers progressive resistance.

It is still a further object of the present invention to provide means for measuring and generating output from the device.

It is yet a further object of the present invention to provide an elastic chamber to indicate varying levels of air egress.

A further object of the present invention is to provide a central cavity that can comfortably accommodate virtually all users.

Yet a further object of the present invention is to provide a stand for easy storage of the device.

SUMMARY OF THE INVENTION

The present invention relates to a hand and arm exercising device. The device, in an elementary form, has an elastic bulb with a central cavity. The elastic bulb has a first port and a second port, fluids in the central cavity being able to pass through the second port.

A first check valve is positioned in the first port such that fluid can freely pass into the central cavity. A chamber is provided which is connected to the second port by a passage. An adjustable bleed valve is positioned in the passage.

It is preferred that the volume of the chamber be less than the volume of the central cavity. It is further preferred that the adjustable bleed valve have an adjustment knob having adjustment indicia for indicating the setting of the adjustable bleed valve.

In one preferred embodiment, the chamber is rigid. When the chamber is rigid, it is further preferred to provide a pressure gauge to allow the user of the exercise device to monitor the pressure in the chamber.

In an alternate embodiment, the pressure gauge is an electronic sensor which is connected to a processor. The processor calculates frequency, elapsed time, and pressure and has means for visually displaying the output.

It is still further preferred that a reference indicator is provided on the elastic bulb, the reference indicator being fixed in position relative to the adjustment indicia on the adjustment knob of the adjustable bleed valve.

In an alternative embodiment, the chamber is an elastic chamber that is expandable under pressure. In this embodiment, it is preferred that a second check valve to be provided in the second port of the elastic bulb to prevent fluid from entering the central cavity through the second port.

It is further preferred that chamber indicia are provided on the elastic chamber to indicate different levels of inflation of the elastic chamber. It is still further preferred that a stand is provided which has a substantially planar base and an upper end which is recessed to support the elastic bulb for convenient storage.

In another embodiment, the shape of the central cavity of the elastic bulb has a preferably cylindrical shape with a length in the range of 2.5 inches to 3.75 inches and a diameter in the range of 1.25 inches to 2.5 inches.

In another embodiment, the shape of the central cavity of the elastic bulb has a preferably ellipsoidal shape with a length in the range of 2.5 inches to 3.75 inches and a diameter in the range of 1.25 inches to 2.5 inches.

DESCRIPTION OF THE PREFERRED EMBODIMENTS

Figure 1:
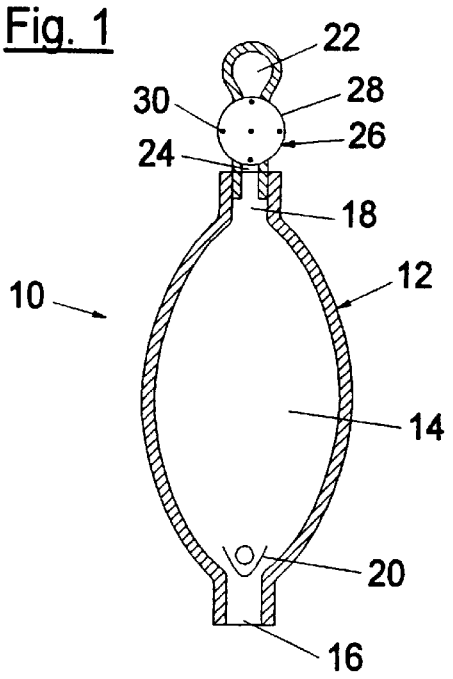
FIG. 1 is a sectional front view showing the preferred embodiment of the present invention.

Referring to FIG. 1, the device 10 is shown comprising an elastic bulb 12 having a central cavity 14, a first port 16, and a second port 18 through which air contained in the central cavity 14 can pass. The elastic bulb 12 is made of a material that returns to its original configuration after deformation. A first check valve 20 is positioned in the first port 16 such that atmospheric air can freely pass into the central cavity 14, and a rigid chamber 22 is provided which is connected to the second port 18 by a passage 24. An adjustable bleed valve 26, having an adjustment knob 28 with adjustment indicia 30, is positioned in the passage 24.

When the elastic bulb 12 is squeezed, air from the central cavity 14 is forced through the second port 18 because it cannot exit through the first port 16 due to the first check valve 20. The air passes through passage 24 and becomes pressurized because rigid chamber 22 prevents further air movement. The only means available for air egress is through the adjustable bleed valve 26. When the adjustment knob 28 is turned so that adjustable bleed valve 26 is slightly open, the pressurized air exits through the adjustable bleed valve 26 slowly, releasing air at a low rate as the elastic bulb 12 is squeezed. The level of resistance is determined by how hard the elastic bulb 12 is squeezed at any given time interval which determines the rate of air egress through the adjustable bleed valve 26. As the adjustment knob 28 is turned so that the adjustable bleed valve 26 is progressively opened, the pressurized air exits the adjustable bleed valve 26 at progressively greater rates with a corresponding reduction in resistance levels. In any case when the adjustable bleed valve 26 is in an open position, the resistance encountered when the elastic bulb 12 is squeezed is isokinetic resistance. When the adjustment knob 28 is turned so that the adjustable bleed valve 26 is fully closed, the pressurized air cannot exit through the adjustable bleed valve 26 and the resistance encountered is progressive resistance, getting increasingly more difficult the harder the elastic bulb 12 is squeezed. Upon release of the elastic bulb 12, the first check valve 20 is opened because of the vacuum created by the elastic bulb 12 returning to its original configuration, and the central cavity 14 fills with atmospheric air, making the device 10 ready for the next cycle.

Figure 2:
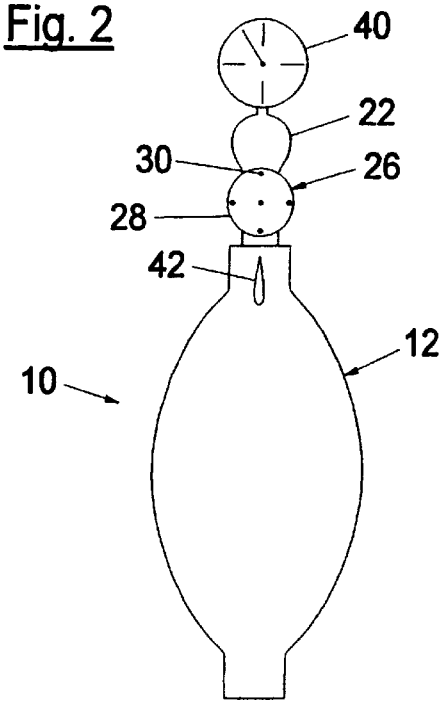
FIG. 2 is a front view of the present invention with a pressure gauge and reference indicator.

FIG. 2 shows the device 10 with a pressure gauge 40 connected to the rigid chamber 22 allowing the user to monitor the pressure in the rigid chamber 22. When the adjustable bleed valve 26 is in a closed position, the pressure gauge 40 gives an indication of hand and arm strength by registering the compression force of the trapped air in the rigid chamber 22. When the adjustable bleed valve 26 is in the open position, the pressure gauge 40 gives an indication of how much resistance is being provided by the isokinetic nature of the adjustable bleed valve 26, allowing for monitoring and maintaining consistency.

A reference indicator 42 secured to the elastic bulb 12 is also provided to note the position of the adjustment knob 28. The relative position of the adjustment indicia 30 on the adjustment knob 28 indicate the level at which the adjustable bleed valve 26 is set and therefore indicate the resistance level encountered when squeezing the elastic bulb 12.

Figure 3:
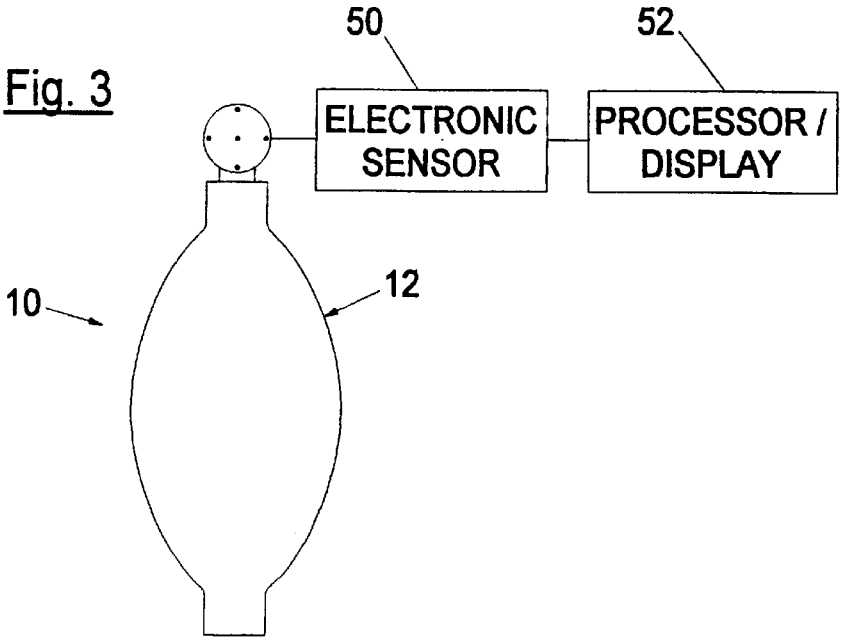
FIG. 3 is a block diagram showing an electronic sensor and a processor having a display.

FIG. 3 is a block diagram of device 10 wherein the elastic bulb 12, when squeezed, generates pressure to an electronic sensor 50. The electronic sensor 50 is connected to a processor 52 which calculates frequency, elapsed time, and pressure and displays the output.

Figure 4:
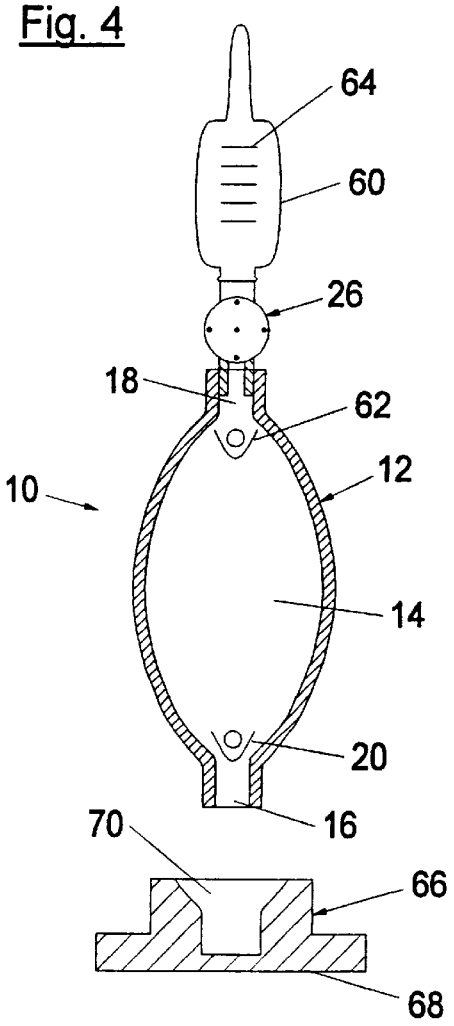
FIG. 4 is a sectional front view of the present invention showing an embodiment with an elastic chamber, chamber indicia, and stand.

In FIG. 4, the chamber is an elastic chamber 60 such as a latex type balloon which inflates as the elastic bulb 12 is squeezed. In this embodiment, it is preferred that a second check valve 62 be provided in the second port 18 to prevent ingress of air into the central cavity 14 through the second port 18. The elastic chamber 60, by virtue of inflation and size, is a rough visual pressure indicator itself. For a more detailed indication of the inflation level and exercise level, chamber indicia 64 are marked on the elastic chamber 60.

When the adjustable bleed valve 26 is fully closed, squeezing the elastic bulb 12 forces air through the second port 18 and into the elastic chamber 60, inflating it further with each repetition because the existing air in the elastic chamber 60 cannot reenter the central cavity 14 because of the second check valve 62. As the elastic bulb 12 reverts back to its original shape, the vacuum it creates draws air into the central cavity 14 through the first check valve 20 in the first port 16. When the elastic bulb 12 is squeezed again, more air flows through the second port 18 into the elastic chamber 60 thereby inflating it further.

When the adjustable bleed valve 26 is not fully closed, squeezing the elastic bulb 12 forces air partially into the elastic chamber 60 and partially out of the adjustable bleed valve 26. Then, the inherent elastic properties of the elastic chamber 60 cause deflation of the elastic chamber 60 and force most of the rest of the air from the elastic chamber 60 and out the adjustable bleed valve 26. With further squeezing repetitions of a frequency particular to the amount at which adjustable bleed valve 26 is open, a consistent level of inflation of the elastic chamber 60 can be sustained as air from the elastic bulb 12 continuously replaces the air exiting the elastic chamber 60 through the adjustable bleed valve 26, providing an indicator which offers positive feedback for the user and which can ensure compliance and exercise consistency. The elastic chamber 60 has a greater length than diameter and has chamber indicia 64 marked on it to display the levels of inflation to be maintained when performing the exercises.

A stand 66 is configured which has a substantially planar base 68 and an upper end 70 which is recessed to hold the device 10 for convenience and to minimize storage space.

Figure 5:
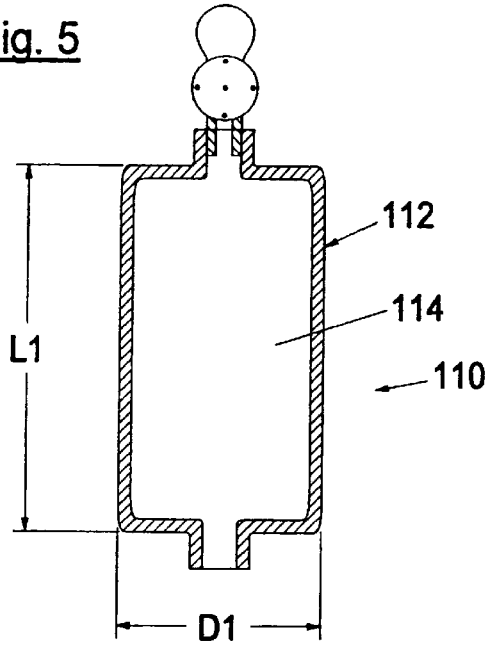
FIG. 5 is a sectional front view of the present invention showing the preferred size and shape of the central cavity.

FIG. 5 shows the shape of the elastic bulb 112 of the device 110. The elastic bulb 112 has a cylindrical shape with a length L1 in the range of 2.5 inches to 3.75 inches and a diameter D1 in the range of 1.25 inches to 2.5 inches.

Figure 6:
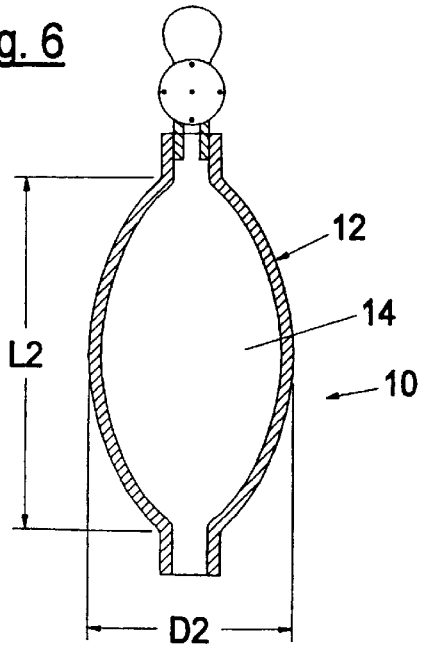
FIG. 6 is a sectional front view of the present invention showing a more preferred size and shape of the central cavity.

FIG. 6 shows the shape of the elastic bulb 12 of the device 10. The elastic bulb 12 has a ellipsoidal shape with a length L2 in the range of 2.5 inches to 3.75 inches and a diameter D2 in the range of 1.25 inches to 2.5 inches.

Anthropometric data accumulated by NASA on men and women in the U.S. Military as well as industry are one of the guidelines used in determining the relative size of the elastic bulb 12. (NASA, Anthropometric Source Book, Volume I, II, III, Reference Publication 1024, NASA Scientific and Technical Information Office) The summary of the data are as follows:

| 50th percentile +/– 1 Standard Deviation (inches) | Males | Females |
|---|---|---|
| Hand Breadth | 3.4 +/– 0.2 | 3.0 +/– 0.2 |
| Grip Breadth, Inside Diameter | 1.9 +/– 0.2 | 1.7 +/– 0.1 |

-continued

| Population Percentiles - 50% Male, 50% Female | 5th | 50th | 95th |
|---|---|---|---|
| Hand Breadth | 2.8 | 3.2 | 3.6 |
| Grip Breadth, Inside Diameter | 1.5 | 1.8 | 2.2 |

In order to accommodate virtually the whole population of users with comfort and without unnecessary strain, the above parameters should be followed resulting in the dimensions shown in FIG. 5 and FIG. 6. The larger diameter can easily be accommodated by those in the 95th percentile while those in the 5th percentile can also enjoy maximum comfort levels due to the structure of the elastic bulb 12 which can be easily deformed to comfortably fit in a smaller hand.

It is to be understood that the forms of the invention herein shown are preferred embodiments and that various changes and combinations of the aforementioned functions and components by those skilled in the art can be made without departing from the spirit of the invention or the scope of the appended claims.

What I claim is:

1. A hand and arm exercising device comprising:

a self-inflating elastic bulb with a central cavity, said self-inflating elastic bulb having a first port and a second port;

a one-way valve positioned in said first port such that fluid can pass into said central cavity;

a chamber, said chamber containing a volume less than that of said central cavity;

a passage between said chamber and said second port; and an adjustable bleed valve positioned in said passage.

2. The hand and arm exercising device of claim 1 wherein said adjustable bleed valve has an adjustment knob, said knob having adjustment indicia.

3. The hand and arm exercising device of claim 1 wherein said chamber is substantially rigid.

4. The hand and arm exercise device of claim 3 further comprising:

a pressure gauge positioned to monitor the pressure in said substantially rigid chamber.

5. The hand and arm exercising device of claim 2 wherein:

a reference indicator is secured to said self-inflating elastic bulb, said reference indicator being fixed relative to said adjustment indicia on said adjustment knob of said adjustable bleed valve.

6. The hand and arm exercising device of claim 4 wherein:

said pressure gauge is an electronic sensor; and further wherein said electronic sensor is connected to a processor; and further wherein said processor has means for display.

7. The hand and arm exercising device of claim 1 wherein said chamber is expandably elastic, said hand and arm exercising device further comprising:

a second one-way valve positioned in said second port such that fluid can exit said central cavity.

8. The hand and arm exercising device of claim 7 wherein said expandably elastic chamber has chamber indicia marked on said expandably elastic chamber.

9. The hand and arm exercising device of claim 1 further comprising:

a stand with a substantially planar base and a recessed upper end, said recessed upper end supporting said self-inflating elastic bulb.

10. The hand and arm exercising device of claim 1 wherein said central cavity of said self-inflating elastic bulb is cylindrical in shape with a length in the range of 2.5 inches to 3.75 inches and a diameter in the range of 1.25 inches to 2.5 inches.

11. The hand and arm exercising device of claim 1 wherein said central cavity of said self-inflating elastic bulb is ellipsoidal in shape with a length in the range of 2.5 inches to 3.75 inches and a diameter in the range of 1.25 inches to 2.5 inches.

* * * * *